US009890540B2

(12) United States Patent
Weitzer

(10) Patent No.: US 9,890,540 B2
(45) Date of Patent: Feb. 13, 2018

(54) FLOOR OR WALL COVERING SYSTEM WITH LAYING UNITS WHICH CAN BE COMBINED IN A MODULAR MANNER

(75) Inventor: Wilfried Weitzer, Weiz (AT)

(73) Assignee: Weitzer Holding GmbH, Weiz (AT)

( * ) Notice: Subject to any disclaimer, the term of this patent is extended or adjusted under 35 U.S.C. 154(b) by 0 days.

(21) Appl. No.: 14/118,549

(22) PCT Filed: Apr. 26, 2012

(86) PCT No.: PCT/EP2012/057688
§ 371 (c)(1),
(2), (4) Date: Jun. 11, 2014

(87) PCT Pub. No.: WO2012/156192
PCT Pub. Date: Nov. 22, 2012

(65) Prior Publication Data

US 2014/0283468 A1 Sep. 25, 2014

(30) Foreign Application Priority Data

May 16, 2011 (EP) ..... 11166261
May 23, 2011 (EP) ..... 11167166
Jun. 17, 2011 (EP) ..... 11170412

(51) Int. Cl.
*E04F 11/16* (2006.01)
*E04F 15/00* (2006.01)
(Continued)

(52) U.S. Cl.
CPC ..... *E04F 13/24* (2013.01); *E04F 11/108* (2013.01); *E04F 11/1045* (2013.01);
(Continued)

(58) Field of Classification Search
CPC ..... E04F 11/17; E04F 11/108; E04F 13/10; E04F 13/24; E04F 15/18; E04F 15/206;
(Continued)

(56) References Cited

U.S. PATENT DOCUMENTS 2,151,505 A * 3/1939 Elmendorf ..... 52/506.05
3,341,996 A * 9/1967 Jones ..... E04F 15/02144 427/127
(Continued)

FOREIGN PATENT DOCUMENTS

CN 201460144 U 5/2010
DE 2739134 A1 3/1979
(Continued)

OTHER PUBLICATIONS

Translation of Gruss (EP 2206850) provided by espacenet.com.*
(Continued)

*Primary Examiner* — Brian D Mattei
(74) *Attorney, Agent, or Firm* — Lewis Roca Rothgerber Christie LLP

(57) ABSTRACT

Surface laying unit (100) for laying with other surface laying units (100) on an underlying surface (300), wherein the surface laying unit (100) has a useful layer (102) and a connecting structure (104) which is provided directly on an underside of the useful layer (102) and which is designed for connecting to the underlying surface (300).

8 Claims, 7 Drawing Sheets

(51) Int. Cl.

| | |
|---|---|
| ***E04F 13/24*** | (2006.01) |
| ***E04F 11/108*** | (2006.01) |
| ***E04F 11/17*** | (2006.01) |
| ***E04F 13/10*** | (2006.01) |
| ***E04F 15/18*** | (2006.01) |
| ***E04F 15/20*** | (2006.01) |
| ***E04F 11/104*** | (2006.01) |
| ***E04F 15/02*** | (2006.01) |
| ***E04F 15/04*** | (2006.01) |
| ***E04F 13/077*** | (2006.01) |
| ***E04F 15/16*** | (2006.01) |
| ***E04F 19/00*** | (2006.01) |
| ***E04F 15/024*** | (2006.01) |

(52) U.S. Cl.
CPC ..... *E04F 11/17* (2013.01); *E04F 13/077* (2013.01); *E04F 13/10* (2013.01); *E04F 15/02138* (2013.01); *E04F 15/02144* (2013.01); *E04F 15/02172* (2013.01); *E04F 15/02405* (2013.01); *E04F 15/042* (2013.01); *E04F 15/16* (2013.01); *E04F 15/18* (2013.01); *E04F 15/206* (2013.01); *E04F 19/00* (2013.01); *E04F 2290/042* (2013.01)

(58) Field of Classification Search
CPC ..... E04F 15/02133; E04F 15/02138; E04F 15/02144
USPC ..... 52/177, 390–392, DIG. 4
See application file for complete search history.

(56) References Cited

U.S. PATENT DOCUMENTS

| | | | | |
|---|---|---|---|---|
| 3,717,247 | A * | 2/1973 | Moore | 206/321 |
| 4,233,793 | A * | 11/1980 | Omholt | 52/390 |
| 5,985,398 | A * | 11/1999 | Bellegarde | 428/54 |
| 8,079,184 | B2 * | 12/2011 | Wiercinski et al. | 52/177 |
| 2003/0033777 | A1 * | 2/2003 | Thiers et al. | 52/390 |
| 2006/0080910 | A1 * | 4/2006 | Cornia | 52/177 |
| 2006/0154017 | A1 * | 7/2006 | Shepard | A44B 18/0049 428/99 |
| 2008/0271404 | A1 * | 11/2008 | Abrahams | E04F 15/02 52/589.1 |
| 2009/0084049 | A1 * | 4/2009 | Clark et al. | 52/177 |
| 2010/0236180 | A1 * | 9/2010 | Pacione et al. | 52/578 |
| 2011/0250434 | A1 * | 10/2011 | Schauer et al. | 428/319.7 |

FOREIGN PATENT DOCUMENTS

| | | | |
|---|---|---|---|
| DE | 3804995 | A1 | 8/1989 |
| DE | 4228597 | A1 | 3/1994 |
| DE | 19901595 | A1 | 8/2000 |
| DE | 19940837 | A1 | 11/2000 |
| DE | 10354789 | A1 | 6/2005 |
| DE | 102007038669 | A1 | 1/2009 |
| DE | 10 2007 043 202 | A1 | 3/2009 |
| EP | 0102211 | A2 | 3/1984 |
| EP | 2206850 | A1 | 7/2012 |
| WO | WO 96/18782 | | 6/1996 |
| WO | WO 2005/049935 | A2 | 6/2005 |
| WO | WO 2006/075198 | A1 | 7/2006 |

OTHER PUBLICATIONS

Translation of Bockl (DE 19940837) provided by espacenet.com.*
Translation of Schwitte (DE 10354789) provided by espacenet.com.*
Translation of Tunte (DE 102007038669) provided by espacenet.com.*
Definition of "adhesive" provided by dictionary.com.*
ISR issued in International Application No. PCT/EP2012/057688, dated Jul. 17, 2012, 5 pages.
Written Opinion issued in International Application No. PCT/EP2012/057688, dated Jul. 16, 2012, 7 pages.
English Abstracts for EP 2206850 A1, DE 19940837 A1, DE 102007038669 A1, DE 10354789 A1, CN 201460144U, DE 4228597 A1,DE 3804995 A1, DE 2739134 A1, WO 2005/049935 A2, 4 pages.
Office action dated Nov. 24, 2015 in parallel application EP 12717694.9 (no translation available).

* cited by examiner

FLOOR OR WALL COVERING SYSTEM WITH LAYING UNITS WHICH CAN BE COMBINED IN A MODULAR MANNER

This application is a National Phase Patent Application and claims priority to and benefit of International Application Number PCT/EP2012/057688, filed on Apr. 26, 2012, which claims the priority of European Patent Application EP 11166261.5, filed on 16 May 2011, European Patent Application EP 11167166.5, filed on 23 May 2011, and European Patent Application EP 11170412.8, filed on 17 Jun. 2011, and the entire disclosures of which are incorporated herein by reference.

The invention relates to a surface laying unit for laying with other surface laying units on a substrate. The invention further relates to a substrate laying unit for laying on a substrate with other substrate laying units and as an underlay for surface laying units. The invention furthermore relates to an arrangement for forming a parquet floor on a substrate. The invention also relates to methods for laying coverings. The invention further relates to a use.

Parquet is a floor covering consisting of wood for rooms in closed buildings. The wood, generally hardwood from deciduous trees, is sawn into small pieces and assembled according to defined patterns. Parquet is different from a laminate covering. Laminate coverings consist of wood fibre materials as the carriers and are coated with melamine resin; the visible wood surface in this case consists of a laminated-in paper layer with a wood pattern (decorative layer impregnated with melamine resin).

Parquet and other conventional wooden panels as floor or wall covering are relatively time-consuming to lay. The renovation or replacement of such floor or wall coverings requires a high outlay in terms of time and costs.

WO 2005/49935 discloses a panel for a covering comprising a plurality of panels, in particular floor or wall covering, for laying on a substrate on site, with a panel element and an underlayer attached to the rear of the panel element. To be able to lay the panel simple and at the same time achieve good acoustic and sound transmission properties, it is provided for the underlayer to be formed for connecting to the substrate.

However, the replacement of a panel according to WO 2005/049935 still requires a high outlay, since panels must be replaced completely if damaged, although parts of them may still be undamaged. This is also disadvantageous in terms of conservation of resources and environmental protection.

It is an object of the present invention to make it possible to install floor or wall covering in a resource-conserving, environmentally friendly, flexible manner, with low outlay.

This object is achieved by the subject matter comprising the features according to the independent patent claims.

According to an exemplary embodiment of the present invention, a surface laying unit (in particular a parquet laying panel) is created for laying with other surface laying units on a substrate, the surface laying unit comprising a wear layer (in particular formed as a rigid board), in particular consisting of wood (further particularly a solid wood board, further particularly a rectangular solid wood board), and a connecting structure which is attached directly to an underside of the wear layer (or to a substrate-side face of the wear layer) and is configured for connecting to the substrate.

According to another exemplary embodiment of the present invention, a substrate laying unit (in particular a floor laying panel) is provided for laying on a substrate with other substrate laying units and as an underlay for surface laying units, the substrate laying unit comprising a stability layer (in particular a wood board, further particularly a rectangular wood board) for stabilising a surface laying unit which can be attached above the stability layer (i.e. the surface laying unit is arranged on a face of the stability layer facing away from the substrate) and a connecting structure which is attached to an upper side of the substrate laying unit (or to a face of the substrate laying unit facing away from the substrate) and is configured for connecting to the surface laying unit, an underside of the substrate laying unit opposite the upper side (or a face of the substrate laying unit facing the substrate) being configured for connecting to the substrate.

According to yet another exemplary embodiment of the invention, an arrangement for forming a covering, in particular a parquet floor or a wall covering, is provided on a substrate, the arrangement comprising a plurality of substrate laying units, which can be laid together on the substrate to cover the substrate and can be connected to the substrate, a plurality of surface laying units, which are provided separately from the substrate laying units and are configured to cover the laid substrate laying units, and a connecting structure (which can be part of a substrate laying unit and/or part of a surface laying unit) on a boundary between the substrate laying units and the surface laying units, the connecting structure being configured for the detachable connection of the surface laying units to the substrate laying units.

According to a further exemplary embodiment of the present invention, a method for laying coverings such as parquet is provided, in the method a plurality of surface laying units being laid on a substrate, each of the surface laying units comprising a wear layer consisting of wood and a connecting structure, which is directly attached to an underside of the wear layer, for connection to the substrate, the plurality of surface laying units being connected to the substrate by means of the connecting structure, and at least some of the laid surface laying units being detached from the substrate by removing the respective wear layer together with the connecting structure attached thereto.

According to a further exemplary embodiment of the present invention, a method for laying coverings such as parquet is created, in the method a substrate being covered with a plurality of substrate laying units by connecting an underside of the substrate laying units to the substrate, and the laid substrate laying units being covered with a plurality of surface laying units by detachably connecting an upper side of the substrate laying units with an underside of the surface laying units by means of a connecting structure, the connecting structure being configured for detachably connecting of the surface laying units to the substrate laying units.

According to a further exemplary embodiment of the present invention, a wear layer consisting of wood with a connecting structure attached thereto is used as the surface laying unit for detachable attachment to the substrate and for subsequent detachment (in particular without tools) from the substrate, in particular for refurbishment or renovation of a parquet floor.

In the context of the present description, a "surface laying unit" can mean in particular a parquet module, the wear layer of which is outwardly exposed or visible (where necessary still covered with an optional protective coating) when laid on or above a substrate. The surface laying unit can for example be laid by means of a connecting structure on the underside of the surface laying unit and/or by means of a connecting structure on the upper side of the substrate laying unit connected to the surface laying unit. It is also alternatively possible to connect the surface laying unit directly to a substrate, in particular to a building substrate, for example can be laid directly (that is, without further components therebetween) on the substrate laying unit. The term surface laying unit is to be understood as meaning that it can be laid on any desired flat substrate, for example a horizontal face (in particular a floor or ceiling face), an inclined face (in particular a ramp) or a vertical face (in particular a wall face).

Within the context of the present description, a "substrate laying unit" can mean in particular a parquet module which can be connected directly to a substrate, in particular to a building substrate, for example can be laid directly (that is, without further components therebetween) on the substrate. This laying can for example take place by means of a connecting structure on the underside of the substrate laying unit and/or by means of a connecting structure on the upper side of the substrate. Floating laying of the substrate laying unit on the substrate is also possible.

Within the context of the present description, a "substrate" can mean in particular any flat or essentially flat face which can be covered with a wood covering. The substrate can be a substrate of a building (for example a building floor, a building ceiling or a building wall), i.e. a substrate on site. It is however also possible to use stairs or steps (in particular horizontal and/or vertical surfaces of steps) as the substrate, on which surface laying units and/or substrate laying units according to the invention can then be laid with any configuration described within the context of the present application. The substrate for a surface laying unit can however also be a substrate laying unit if a substrate laying unit is to be interposed optionally but advantageously between an on-site substrate and a surface laying unit.

Within the context of the present description, a "wear layer" can mean in particular a layer close to the surface or a surface layer or a board on which the actual mechanical and/or chemical load on the laid floor or wall covering takes place. In the case of parquet, this is the layer which a user uses as a floor to walk on.

Within the context of the present description, a "stability layer" can in particular mean a layer remote from the surface or a board which acts to stabilise the laid floor or wall covering as a whole. To be able to fulfil this function, where necessary with the additional function of reducing walking noise, the stability layer can preferably be thicker, further preferably at least 3 mm thicker, than the wear layer. A person skilled in the art will understand that completely different dimensions are also possible.

Within the context of the present description, a "connecting structure" can in particular mean any physical structure which is specifically adapted to enter into a connection specifically to the properly adjacent element, i.e. to exert a fastening force on the latter. A connecting structure can be formed as a layer or as one or more specifically placed elements.

Within the context of the present description, a "board-like, rigid layer" can mean a layer which has the mechanical properties of a board. Such a layer cannot for example be wound onto a roll.

Within the context of the present description, an "upper side" of a layer or element can in particular mean such a main face of the said layer or element which faces away from the substrate when the said layer or element is laid properly. Accordingly, an "underside" of a layer or element can in particular mean such a main face of the said layer or element which faces the substrate when the said layer or element is laid properly.

Within the context of the present description, "detachably connecting" of two elements by means of a connecting structure can in particular mean that after the formation of such a connection, it can be detached reversibly and non-destructively by application of a detaching force. Thanks to such a non-destructive detachment, the connecting structure can be reused after detachment, in particular can be reused at least ten or at least a hundred times without the connecting function suffering or being impaired as a result. The detachment of such a connection can be carried out by a user without using a tool. The application of a detaching force of less than 200 N, in particular of less than 100 N, further particularly of less than 50 N can be sufficient for such a detachment. To prevent undesirable detachment of the laid covering, the detachment force should be at least 10 N, in particular more than 20 N, further particularly more than 30 N. However, the forces can also have different magnitudes.

According to an exemplary embodiment of the invention, it is made possible, not for an entire, laid floor or wall covering which is attached to a substrate to be removed when it is to be replaced, but rather it can be sufficient for only an upper part of the floor or wall covering to be detached from a lower part of the floor or wall covering.

In other words, a worn wear layer can for example be replaced by being detached from an underlay in an isolated manner, i.e. only together with a connecting structure attached thereto. The said underlay can have a remaining part of the floor or wall covering, in particular comprising a stability and/or counteracting veneer layer. Alternatively, the underlay can also be an on-site substrate, such as a screed or concrete floor or wooden floor or plastic floor. In both cases it is sufficient to remove a relatively thin upper wear layer with a connecting structure attached thereto and replace it with a new wear layer with a connecting structure. Since the connecting structure can be provided such that it can be detached non-destructively from the underlay, the outlay for replacing the wear layer is conceivably low, since the wear layer can be replaced simply without the use of tools or the time-consuming removal of adhesive layers from the underlay. The wear layer can be replaced not only in the case of wear or other surface damage of the same, but it is also possible to replace parquet without significant outlay on time and work merely by changing the outwardly visible wear layer which is decisive for the surface load together with a connecting structure arranged thereon.

This makes resource-conserving laying of parquet and other floor or wall coverings possible, since only the actually worn wear layer including the connecting structure, not the entire parquet, has to be replaced. This represents a preferred solution in terms of sustainability and environmental protection too, and furthermore offers a user a high degree of flexibility in that it is possible for simply an upper region of the layer sequence to be removed.

It is however also possible to replace a substrate laying unit which optionally lies under the surface laying unit in a simple and isolated manner if it is configured to be connectible detachably to an on-site substrate, likewise using one or several connecting structures, which can be arranged between the substrate and the substrate laying unit.

Overall, a modular system is created, with which parquet can not only be laid quickly, but also renewed, refurbished or renovated with low outlay without large amounts of still functional substrate-side wood comprising to be replaced at the same time, as in conventional solutions.

In other words, according to one exemplary embodiment of the invention, a parquet element formed conventionally in one piece and inseparably can be divided into a surface laying unit and a separate or reversibly separable substrate laying unit. Corresponding to the partial functions of an upper wood layer and a lower wood layer in a conventional parquet element, a surface laying unit (comprising a wear layer which is exposed to the direct loading and use as a walking surface) and a separable and reusable substrate laying unit (stability and substrate connecting layer, which is placed in a floating manner on the substrate or connected fixedly thereto) can then according to the invention also be structurally separate. The surface laying unit and the substrate laying unit can then be replaced individually but can also be connected securely by means of at least one connecting structure attached therebetween. The amount of material to be replaced as required if only one of the partial functions fails is thereby reduced, since the component which assumes the respective other and still intact partial function does not have to be replaced. Further, the laying and renovation outlay of correspondingly laid parquet is significantly reduced, since the connecting structure can be configured to ensure simple manual removal and replacement of individual surface laying units and/or substrate laying units without a high-outlay relaying of the entire parquet layer being necessary.

Additional exemplary embodiments of the surface laying unit are described below. These also apply to the substrate laying unit, the arrangement, the method and the use.

Exemplary embodiments of the invention are not limited to wood, but apply to all materials and coverings, e.g. tiles, laminate, PVC covering, carpets etc.

Both the surface laying units and the substrate laying units can be produced in virtually any desired formats. This comprises in particular any quadrilateral configuration, further particularly rectangular arrangements. Other shapes, such as polygons, are however also possible.

According to one exemplary embodiment, the connecting structure can be configured for detachably connecting, in particular detachably connecting with manual muscular force and/or without tools, to the substrate. It can thereby be made possible, without the provision of a separate tool or without destructive treatment, for the wear layer (e.g. including a part of the connecting structure or including the entire connecting structure) to be removed and where required replaced by another one.

According to exemplary embodiments, it is also possible for specific equipment to be used for installation and/or removal (e.g. heat, radiation, mechanical aids).

According to one exemplary embodiment, the connecting structure can be configured for adhesive-free connecting to the substrate. A high-outlay adhesive connection does not then have to be created between the wear structure and the underlay, but it is also possible for the connecting structure to exert a different type of connecting force, which allows reversible removal without tools (or with quite simple tools) and without destroying the connecting structure. The force used can be an electrical, magnetic or mechanical connecting force, which however should meet the criterion of reversibility, that is, can be overcome by a user simply removing the surface laying unit from the surface.

According to one exemplary embodiment, the connecting structure can be a connecting layer, which is attached over its entire area to the entire underside of the surface laying unit and thus covers the entire underside. The connecting structure can thus be attached in a mat-like manner as a full-area layer, with which a particularly good connecting effect and additionally a continuous sealing and insulating effect is achieved with respect to the substrate. In this exemplary embodiment, the connecting structure can also be used to protect the wear layer from influences from below.

Alternatively, the connecting structure can be a connecting layer which is attached over only some of the area to a part of the underside. Therefore, it is possible for only a partial area of the underside to be laid in a material-saving manner with the connecting layer.

The connecting layer can for example have a thickness between 10 μm and 3 mm, in particular between 100 μm and 1 mm. It should also be pointed out here that completely different dimensions are possible.

According to one exemplary embodiment, the connecting structure can be configured as a structured connecting layer which only covers part of the underside of the wear layer. According to this exemplary embodiment, an originally full-area connecting layer can be provided with a recess or a plurality of recesses. The connecting force can be set in a targeted manner thereby and thus a covering can thus be formed which makes it possible for a user to remove the surface laying unit again without tools and merely with the application of muscular force. Thanks to such structuring, it is also possible to create a targeted thermal bridge, for example if underfloor heating is attached in the substrate, which is intended to have a thermal effect through a floor covering.

According to one exemplary embodiment, the connecting structure can be formed from a plurality of connecting elements separate from each other (for example individual permanent magnets or individual suction cups), which are attached to the underside of the wear layer. According to this exemplary embodiment, for example individual connecting elements can be placed at targeted points on the wear layer, for example in corner regions or at certain distances from each other. It is thereby possible on the one hand to set the magnitude of a connecting force, the connecting structure can on the other hand be attached to the wear layer in a very material-saving and lightweight manner.

According to one exemplary embodiment, the connecting structure can be formed from a magnetic mat, a plurality of magnetic elements (for example individual permanent magnets), a hook-and-loop fastener mat (which comprises a component of a hook-and-loop fastener), a detachable adhesive layer (for example double-sided adhesive tape), an electrostatically charged mat (it being possible for the charge carrier to be enclosed in the interior of such a mat), an anti-slip mat (for example consisting of a rubber material with high static friction), a sprayed or painted layer and/or an arrangement of suction cups. Magnetic, mechanical, electrical forces or a combination thereof can thus be used to realise the detachable or reversible connecting characteristics between the surface laying unit and the substrate. The connecting structure can be fastened permanently to the wood layer, in particular sprayed as a dryable spraying fluid, applied as a dryable paint or laminated, fused or adhesively bonded thereon as a flexible or rigid solid body. For example, a magnetic layer can be applied to the wear layer as a liquid suspension of magnetic particles (for example colloids or magnetic chips) and a solvent etc. After the suspension has dried, a thin magnetic layer which is inexpensive to produce then remains on the wear layer. The connecting structure can also have a hot melt adhesive. A hot melt adhesive is applied in melted form and then adheres to the respective surface when it cools back down to a temperature below the melting point. A nanomat can also be used as the connecting structure, i.e. a mat comprising an arrangement of nanostructures for producing the connection.

According to one exemplary embodiment, the entire surface laying unit, in particular the wear layer, can have a thickness in a range between approximately 0.5 mm and approximately 8 mm, in particular between approximately 1 mm and approximately 6 mm, further particularly between approximately 1.5 mm and approximately 4 mm. If the wear layer becomes worn, this alone, that is, without the substrate laying unit which may be arranged therebeneath, can thus be replaced, which allows a material- and resource-conserving way of working. Advantageously, the thickness of the wear layer can be selected to be such that at least one sanding operation of a surface of the wear layer is allowed before replacement of the surface laying unit.

According to a preferred exemplary embodiment, a side face of the wear layer in the surface laying unit can be provided entirely or partially with the connecting structure (for example with a magnetic layer), so that laterally adjacent surface laying units are connected to each other by means of the connecting structure when in the laid state. In particular, according to an advantageous embodiment of the invention, the peripheral side face of the surface laying units and/or of the substrate laying units can thus also be provided entirely or partially with a connecting structure comprising the above-described features. For example, a connecting mat or connecting layer on a respective main face (upper side or underside) of the surface laying units and/or of the substrate laying units can also be formed (for example turned over) on the side faces, with which the connecting structure can simultaneously also have a lateral fastening effect. Connecting structures on the main face and side face can be formed in one piece or separately. According to one exemplary embodiment, a side face of the stability layer in the substrate laying unit can be provided entirely or partially with the connecting structure, so that laterally adjacent substrate laying units are connected to each other by means of the connecting structure when in the laid state.

According to one exemplary embodiment, an upper side of the wear layer, which is opposite an underside of the wear layer, on which the connecting structure is arranged, can be provided with a protective coating. Such a protective coating (for example parquet varnish, floor oil or wax) can protect the wear layer from being walked on by a user or from other environmental influences of chemical and/or mechanical types.

According to one exemplary embodiment, a main face of the surface laying unit can have an area in a range between approximately 0.001 $m^2$ and approximately 0.5 $m^2$, in particular in a range between approximately 0.01 $m^2$ and approximately 0.1 $m^2$. For example, an individual bar can have surface dimensions of approx. 490 mm×70 mm. The surface laying units can thus be dimensioned such that a parquet comprising an outwardly conventional appearance can be laid therewith. However, the manner of laying and replacing such a parquet is greatly simplified compared to conventional systems. Exemplary embodiments of the invention are not limited with respect to certain materials or certain optical effects.

According to one exemplary embodiment, the surface laying unit can consist exclusively of the wear layer (where necessary also provided with a thin protective coating, for example having a thickness between 1 μm and 100 μm, but can also be thicker) and the connecting structure. In other words, according to one exemplary embodiment, the surface laying unit comprises no further components except for the wear layer and the connecting structure. Optionally, another protective varnish can be provided on the upper side of the wear layer to protect the wear layer from environmental influences. A surface laying unit is thereby created which is particularly simple to produce, lightweight and inexpensive and can replace conventional parquet alone or in combination with substrate laying units, but is much simpler to lay and replace.

According to one exemplary embodiment, the wear layer can be produced from solid wood. Thus, according to this exemplary embodiment, the wear layer can consist only of wood as the component. It can for example be produced from solid wood in one piece.

According to one exemplary embodiment, the surface laying unit can have a further (second) wear layer, which is arranged opposite the wear layer (which is then referred to as the first wear layer), separated by the connecting structure, so that the surface laying unit is configured as a reversible covering (see FIG. 11). Like the wear layer, the further wear layer can have any of the configurations described in the present application. In this configuration, the connecting structure can take effect from a surface of the surface laying unit through the two wear layers, which can be achieved for example with a magnetic mat or with a connecting layer which exerts and electrical force. Owing to the indirect effect of the force of the connecting structure through the respective wear layer, it can be advantageous to make the two wear layers sufficiently thin (for example between 1.5 mm and 4 mm thick, for example if the wear layers are produced from wood). The two wear layers can be configured in such a manner that the surface laying unit is initially laid in such a manner that the first wear layer is arranged on a parquet surface and the second wear layer is arranged facing the substrate (a corresponding substrate laying unit or an on-site substrate). The connecting structure in the interior of the surface laying unit then effects a fixed connection of the laid covering in cooperation with another connecting layer (for example a further magnetic layer or metal layer) on the substrate (substrate laying unit or on-site substrate). The surface laying unit can also be removed from the substrate and turned over, so that the functions of the two wear layers are then inverted. Such an arrangement is particularly resource-conserving.

According to one exemplary embodiment, in the surface laying unit, the wear layer can have a hard covering layer and a sound-absorbing structure, which is attached directly to a main surface, in particular directly to an underside, of the hard covering layer and is configured to absorb sound on loading of the hard covering layer with a sound-generating load. The hard covering layer can be formed as a surface layer. Within the context of the present description, a "hard covering layer" can mean in particular a layer close to the surface, a layer facing the surface or a surface layer on or near which the actual mechanical and/or chemical loading takes place on the laid floor or wall covering. In the case of parquet, this is the layer which a user uses as a floor to walk on. The hard covering layer can be configured as a rigid layer, in particular as a board or board-like structure. The hard covering layer can be formed to be perceived by a user optically when the user looks at the properly laid surface laying unit. Within the context of the present application, a "sound-absorbing structure" means in particular a physical body, for example in the form of a (continuous or intermittent) sound-absorbing layer, which is attached directly to the hard covering layer and, when a mechanical load acts on the hard covering layer, damps or absorbs the sound waves generated thereby and/or undergoes a perceptible mechanical deflection. Such a sound-absorbing structure can be formed from a continuous, soft-elastic layer which is fastened to an underside of the hard covering layer or can be formed from individual, cohesive or non-cohesive physical structures which only partially cover an underside of the hard covering layer. The described configuration of the invention is based on the finding that walking noise or other sound phenomena, which result from mechanical loading of a hard covering layer directly above the sound-absorbing structure, can be suppressed particularly efficiently with a sound-absorbing structure of a substrate covering arranged close to the surface. While it is conventionally known to apply a damping structure to the underside of a parquet, that is, an arrangement of layers for example 20 mm to 35 mm thick in total, the invention is based on the finding that the measurable noise production is significantly reduced [owing to] the direct attachment of the sound-absorbing structure to the underside of a hard covering layer, which is likewise flexible owing to its low thickness. Experimental findings of the applicant have produced these results.

According to one exemplary embodiment, the surface laying unit can have a stabilisation structure for stabilising the wear layer, in particular for absorbing forces exerted from the side of a wood layer of the wear layer. The stabilisation part structure can in particular be formed to absorb forces exerted from the side of the hard covering layer. Experiments of the applicant have shown that when an additional stabilisation part structure is provided on the hard covering layer, forces of the working wood of the hard covering layer can be absorbed or suppressed, as a result of which the stability and the service life of the surface laying unit as a whole can be greatly increased.

According to one exemplary embodiment, the stabilisation structure can be directly adjacent to the wood layer. In this case the stabilising effect thereof is particularly pronounced.

The stabilisation structure can for example be formed as a fibre layer, in particular as a fibre mat. Glass fibre mats or carbon fibre mats are preferred.

Additional exemplary embodiments of the substrate laying unit are described below. These also apply to the surface laying unit, the arrangement, the method and the use.

According to one exemplary embodiment, a first side face of the stability layer can have a first engagement element (for example a groove) and a second side face of the stability layer can have a second engagement element (for example a tongue) complementary to the first engagement element, it being possible to connect the first engagement element to a corresponding second engagement element and to connect the second engagement element to a corresponding first engagement element of corresponding substrate laying units. In particular, the first side face of the stability layer can have a groove and a second side face of the stability layer can have a tongue, it being possible to connect the groove to a corresponding tongue and the tongue to a corresponding groove of corresponding substrate laying units. Alternatively to a tongue and groove connection, any other form-fitting, frictional or force-fitting connection between adjacent side faces or edges of the substrate laying units is also possible. On adjacent side faces of a substrate laying unit, for example, the latter can be brought into engagement with each other by means of a simple click connection. This makes secure laying of the parquet possible even with relatively small connecting forces owing to the connecting structure or connecting structures.

Alternatively, it is also possible to provide the entire peripheral side face of the surface laying units and/or of the substrate laying units with a groove and to insert a tongue as a separate component into the double grooves between adjacent laying units to form a lateral connection.

According to one exemplary embodiment, the substrate laying unit can also have another (i.e. second) connecting structure on a surface of the substrate laying unit facing the substrate, which structure is formed to connect, in particular to connect detachably, to the substrate. According to this exemplary embodiment, the substrate laying unit can have a connecting layer on each of its two upper and lower main surfaces. The substrate laying unit can thus be fastened to a substrate, in particular an on-site substrate (such as a stone, concrete, screed or wooden floor) in a reversible, detachable manner on its underside and can be coupled to a surface laying unit according to the above-described features on the opposite surface. Accordingly, the upper connecting layer of the substrate laying unit can match the lower connecting layer of the surface laying unit. It is however also possible for a connecting layer (for example consisting of suction cups or a hot melt adhesive) to be provided only on a substrate laying unit or only on an opposite surface laying unit, which layer then allows a connection between these two units. According to this configuration, the connecting structure in the above-described surface laying unit can even be omitted. Alternatively, the upper connecting structure on the substrate laying unit can be omitted.

According to this exemplary embodiment, the connecting layers of surface laying unit and substrate laying unit can thus be formed correspondingly. For example, they can be formed as corresponding hook-and-loop fastening faces. For example, one hook-and-loop fastening layer can be of the male type and the other hook-and-loop fastening layer can be of the female type. Alternatively, the two connecting layers can be mutually attractive magnetic layers.

According to one exemplary embodiment, the other connecting layer can be configured to correspond to the connecting layer comprising the above-described features. The connecting structure of the substrate laying unit can have the features which have been described above with reference to the surface laying unit. To avoid repetition, reference is therefore made to the description above.

According to one exemplary embodiment, the stability layer can be formed from a wood-based material, in particular single-piece wood. Such a stability layer consisting of single-piece wood can thus support the entire parquet, formed from the wear layer, the stability layer and optionally a counteracting veneer layer arranged underneath the stability layer.

According to one exemplary embodiment, the connecting structure can be attached directly to the stability layer. In other words, the arrangement can be free of further intermediate layers between the connecting structure and the stability layer, which allows virtually direct connection of the stability layer for example to a wear layer of a surface laying unit.

According to one exemplary embodiment, the substrate laying unit can also have a counteracting veneer layer (can also be a different material (paper etc.)), the stability layer being arranged between the connecting structure and the counteracting veneer layer. Such a counteracting veneer layer can be provided for acoustic reasons or to absorb walking noise and can thus form a conventional three-layer parquet together with the stability layer and the wear layer of the corresponding surface laying unit, the arrangement according to the invention having the advantage that when the wear layer is worn or sanded down, only the latter has to be replaced.

According to one exemplary embodiment, the counteracting veneer layer can be formed from a different wood-based material or a different solid wood from the stabilisation layer. The counteracting veneer layer can thus be optimised with regard to the acoustic damping properties, whereas the stabilisation layer can be optimised for stabilisation purposes.

According to one exemplary embodiment, an underside of the substrate laying unit can have one or several cut-outs, in particular formed as channels, further particularly as cable channels. In this manner, not only can the acoustic damping of the laid parquet be improved, but also the cut-outs can be used to lay electrical, optoelectronic, fluid or other lines underneath the parquet, as a result of which the functionality of the parquet is further improved. The cut-outs can also be used as air vents etc. instead of as cable channels.

According to one exemplary embodiment, the substrate laying unit can be formed in a total thickness between approximately 5 mm and approximately 30 mm, in particular between approximately 8 mm and approximately 20 mm, further particularly between approximately 10 mm and approximately 15 mm. With these thicknesses, an arrangement is made possible which is both stable and sound-absorbing. It is also apparent that the components of the substrate laying unit, which are usually still in a good condition when a wear layer has to be replaced, can remain laid in an unchanged manner without the corresponding material being lost. Only the wear layer or the surface laying unit should be replaced in such an exemplary embodiment.

Additional exemplary embodiments of the arrangement are described below. These also apply to the substrate laying unit, the surface laying unit, the method and the use.

According to one exemplary embodiment, the surface laying units can be formed with the above-described features. In other words, any surface laying unit comprising one or several of the above-described features can be used for such an arrangement.

According to one exemplary embodiment, the substrate laying units can be formed with the above-described features. In other words, any substrate laying unit according to one or several of the above-mentioned features can be used for such an arrangement.

According to one exemplary embodiment, an underside of the surface laying units can be provided with a first connecting structure and an upper side of the substrate laying units can be provided with a second connecting structure, the first connecting structures and the second connecting structures interacting to form a detachable connection between the surface laying units and the substrate laying units when in the laid state. A particularly stable fastening effect between the surface laying unit and the substrate laying unit beneath is possible with such a configuration, since corresponding connecting structures interact (for example exert a magnetic attracting force on each other), in order to create a fixed but still detachable connection in this case.

According to one exemplary embodiment, the surface laying units and the substrate laying units are shaped and dimensioned in such a manner that, when laid, borders between adjacently laid substrate laying units and borders between adjacently laid surface laying units are laterally (in one or preferably two dimensions) offset with respect to each other, in particular arranged without butt joints. It has been found that a particularly stable configuration is achieved when a lateral offset is provided between the substrate laying units and the surface laying units. In other words, side edges of adjacent surface laying units can be laterally offset with respect to side edges of adjacent substrate laying units, so that they are not laid end to end. The stability of the entire arrangement can be significantly improved thereby owing to the mechanical stress properties of wood. It has been found that this measure results in improved fastening particularly when a hook-and-loop connection is used between the substrate laying units and surface laying units.

According to one exemplary embodiment, a spacer structure can be provided on an underside layer of the substrate laying units, it being possible to form an empty space between the underside layer and the substrate by means of the spacer structure and thus to keep the underside layer at a distance from the substrate when the substrate laying units are in the laid state. This makes a double floor structure possible, so that installations of all types can be laid in the cavity. The spacer structure can for example be in the form of underside supports, which can be mounted on the lowest boundary layer of the substrate laying unit.

Additional exemplary embodiments of the method are described below. These also apply to the substrate laying unit, the surface laying unit, the arrangement and the use.

According to one exemplary embodiment, after detachment at least one new surface laying unit is laid instead of at least one detached surface laying unit, each new surface laying unit comprising a wear layer consisting of wood and a connecting structure for connection to the substrate, which structure is attached directly to the underside of the wear layer. In this manner it is possible to replace individual worn or destroyed surface laying units with individual corresponding new surface laying units without detaching the other surface laying units and in particular without detaching or replacing the still possibly functional substrate laying units arranged therebeneath. Renovation or refurbishment of individual surface laying units is thus made possible with minimal outlay. Detachment can be achieved for example by simply removing individual surface laying units without using tools or without destroying a connecting layer. Alternatively, it is also possible to provide specific tools for installing and/or removing the floor or wall coverings.

According to one exemplary embodiment, individual substrate laying units can also be replaced. To this end, first one or several surface laying units, which cover the substrate laying unit to be replaced, should be detached and removed from the parquet composite. The exposed substrate laying unit can then be removed from the substrate. The connecting structure of surface laying units and/or substrate laying unit and/or substrate remain connected to the respective component in an unaffected manner. The new substrate laying unit can then be placed on the substrate. The previously detached surface laying units can then be placed on the new substrate laying unit. This exemplary embodiment also makes use of the modular character of the system.

According to one exemplary embodiment, the detachment can be carried out by a user manually, in particular without tools. The outlay for removing surface laying units and/or substrate laying units is thereby conceivably small.

According to one exemplary embodiment, the wear layer with the connecting structure attached thereto (i.e. the surface laying unit) can be used as single-use parquet. Consequently, for example after the wear layer has been worn out or damaged, the surface laying unit can be replaced by another surface laying unit without sanding or other renovation measures. Alternatively, however, it is also possible to recondition the parquet after wear. E.g. the parquet can be sanded, sealed and reused. According to one exemplary embodiment of the invention, detachable and reconnectable connections are thus created. The detachable and reconnectable element can be a two-layered, three-layered or single-piece parquet (in the case of connecting to the substrate as the counterpiece of the connection). Alternatively or additionally, the detachable and reconnectable element can be a top layer consisting of single-piece wood (both inside the product and/or towards the substrate) having a thickness of for example 1.5 mm to 4 mm.

The said two-layer, three-layer or single-piece parquet element and single-piece top layers can be formed from hard wood, soft wood or modified wood (heat-treated, coated, impregnated, smoked etc.). Other materials which can be used for the detachable element (surface laying unit, substrate laying unit) are plastic, metal, velours etc.

The connection of such an element can take place on different substrates and different configurations.

According to one exemplary embodiment, an areal connection (full-area, strips etc.) can take place on the substrate (wall, ceiling, floor etc.). A two-layer, three-layer or single-piece wood parquet laying unit is then possible on the substrate (for example screed, wood floor, tiles, laminate, PVC covering, carpets etc.). The connecting takes place over the full area or in strips on the counterpiece of the invention.

Alternatively, however, it is also possible to equip a top layer consisting of single-piece wood on a substructure produced on site (consisting of wood-based material or wood composite material or solid wood) with a width and side connection (for example groove, tongue or click). The said substructure (that is, the counterpiece of the connection) can be laid in a floating manner or adhesively bonded over the full area or adhesively bonded in strips. The top layer is attached to this.

According to yet another exemplary embodiment of the invention, a top layer consisting of single-piece wood can be attached to a substrate (for example screed, wood floor, tiles, laminate, PVC covering, carpet etc.). The supplied connecting components can be attached in a floating manner or over the full area to the substrate (screed, wood floor, tiles, laminate, PVC coating, carpet etc.). A width and side connecting is possible between top layer and top layer. Such connections can be formed correspondingly both for the configuration on a substructure produced on site and for the connection of the top layer to the substrate.

Different possibilities can be realised for the connecting structures, including hook-and-loop fastening, magnetic fastening, adhesive tape, detachable adhesives (reversible adhesion) etc. For laying, the substrate laying units and/or the surface laying units can thus be simply placed or laid on top. For removal, they can be simply taken up. The wear layer can act as a top layer and for example be sanded once. This can also be effected e.g. by pulses (current, heat, bimetal effect or others).

Instead of the separate provision of a stability layer (single-piece wood layer) and a counteracting veneer (thin wood layer), these can also be formed in one piece. The wear layer thickness can be reduced to one use cycle, so that it becomes possible for a user to have a new parquet every five years without a great laying outlay being necessary.

European wood types which can be worked to form surface laying units or substrate laying units are oak, beech, sycamore, birch, walnut, cherry, ash, olive, acacia, elm, apple, pear and sweet chestnut. Non-European wood types which can for example be worked to form surface laying units or substrate laying units are merbau, wenge, teak or mahogany.

Wood products, the cross sections of which have been cut out of one log and optionally worked further in a cutting manner (drilling, milling, planing etc.) can be referred to as solid wood, from which surface laying units and/or substrate laying units can be completely or partially formed. In contrast to laminated wood and wood-based materials, the fabric of the wood is not mechanically or mechanically and chemically changed. A connection of different materials is also possible according to the invention.

In the case of multi-layered substrate laying units, wood-based materials are also used as carriers. Wood-based materials can be materials which are produced by comminuting wood and subsequently joining the structural elements together. The size and shape of the wood particles decide the type of wood-based material and its properties. The wood particles can be connected to each other without or with binders or mechanical connections.

Parquet which is formed from surface laying units and/or substrate laying units can be formed for example as single-piece parquet or multi-layered parquet. Single-piece parquet can in particular be built up of single-piece wood pieces, which can be provided with connecting structures according to the invention. Single-piece parquet can be laid roughly and then sanded with a parquet sander. Surface treatment with parquet varnish, floor oil or wax can then take place. Multi-layered parquet can be two-layered or three-layered parquet. The visible surface layer consisting of the defining wood type can be for example 0.5-2 mm to 4 mm thick and adhesively bonded to one or several carrier layers consisting of cheaper coniferous wood or to a carrier board consisting of wood-based material.

The detachably connectable floor covering, i.e. the surface laying unit, can be used for detachable attachment to the substrate in the field of terraces. So on a terrace, where a surface laying unit is exposed to particularly severe wear owing to weathering effects, it is possible for only the thin surface laying unit to be replaced without complete relaying of the entire terrace being necessary.

Further an embodiment relates to a surface laying unit, wherein the connecting structure is configured for detachably connecting, in particular detachably connecting with manual muscular force and/or without tools, to the substrate.

Further an embodiment relates to a surface laying unit, wherein the connecting structure is configured for adhesive-free connecting to the substrate.

Further an embodiment relates to a surface laying unit, wherein the connecting structure is configured as a structured connecting layer which only covers part of the underside of the wear layer.

Further an embodiment relates to a surface laying unit, wherein the wear layer is rigid in a board-like manner, in particular consists of wood.

Further an embodiment relates to a surface laying unit, wherein an upper side of the wear layer, which is opposite an underside of the wear layer, on which the connecting structure is arranged, is provided with a protective coating.

Further an embodiment relates to a surface laying unit, wherein the surface laying unit comprises only one wear layer.

Further an embodiment relates to a surface laying unit, wherein the wear layer is single-layered.

Further an embodiment relates to a substrate laying unit, wherein a first side face of the stability layer comprises a first engagement element, in particular a first groove, and a second side face of the stability layer comprises a second engagement element, in particular a tongue complementary to the first engagement element, wherein the first engagement element can be connected to a corresponding second engagement element and the second engagement element can be connected to a corresponding first engagement element of corresponding substrate laying units.

Further an embodiment relates to a substrate laying unit, wherein the connecting structure is configured for detachably connecting, in particular detachably connecting with manual muscular force and/or without tools, to the surface laying unit.

Further an embodiment relates to a substrate laying unit, wherein the connecting structure is configured for adhesive-free connecting to the surface laying unit.

Further an embodiment relates to a substrate laying unit, wherein the connecting structure is a connecting layer, which is attached over its full area to the entire upper side or over part of its area to part of the upper side of the substrate laying unit.

Further an embodiment relates to a substrate laying unit, wherein the connecting structure is configured as a structured connecting layer which only covers part of the upper side of the substrate laying unit.

Further an embodiment relates to a substrate laying unit, wherein the connecting structure is formed from a plurality of connecting elements, which are separate from each other and are attached to the upper side of the substrate laying unit.

Further an embodiment relates to a substrate laying unit, wherein the connecting structure is selected from a group consisting of a magnetic layer, a magnetic mat, a plurality of magnetic elements, a hook-and-loop fastening mat, a detachable adhesive layer, an electrostatically charged mat, a non-slip mat, a sprayed or painted layer and an arrangement of suction cups.

Further an embodiment relates to a substrate laying unit, further comprising another connecting structure on a surface of the substrate laying unit, which faces the substrate and is formed for connecting, in particular for detachably connecting, to the substrate.

Further an embodiment relates to a substrate laying unit, wherein the other connecting structure is configured in correspondence with the connecting structure.

Further an embodiment relates to a substrate laying unit, wherein the stability layer comprises wood, in particular single-piece wood, or consists thereof.

Further an embodiment relates to a substrate laying unit, wherein the connecting structure is attached directly to the stability layer.

Further an embodiment relates to a substrate laying unit, further comprising a counteracting veneer layer, wherein the stability layer is arranged between the connecting structure and the counteracting veneer layer.

Further an embodiment relates to a substrate laying unit, wherein the counteracting veneer layer is formed from a different wood-based material from the stabilisation layer.

Further an embodiment relates to a substrate laying unit, wherein an underside and/or an upper side of the substrate laying unit comprises one or several cut-outs, in particular formed as channels, further particularly as cable channels or air vents or heating or cooling channels.

Further an embodiment relates to a substrate laying unit, formed in a total thickness between 5 mm and 30 mm, in particular between 8 mm and 20 mm, further particularly between 10 mm and 15 mm.

Further an embodiment relates to a substrate laying unit, wherein a side face of the substrate laying unit is provided at least partially with the connecting structure, so that laterally adjacent substrate laying units are connected to each other by means of the connecting structure when in the laid state. Further an embodiment relates to an arrangement, wherein an underside of the surface laying units is provided with a first connecting structure and an upper side of the substrate laying units is provided with a second connecting structure, wherein the first connecting structures and the second connecting structures interact to form a detachable connecting between the surface laying units and the substrate laying units when in the laid state.

Further an embodiment relates to an arrangement, wherein the surface laying units and the substrate laying units are sized and shaped in such a manner that, when in the laid state, boundaries between adjacently laid substrate laying units and boundaries between adjacently laid surface laying units are offset with respect to each other, in particular arranged without butt joints.

Further an embodiment relates to an arrangement, comprising a spacer structure on an underside layer of the substrate laying units, wherein an empty space can be formed between the underside layer and the substrate by means of the spacer structure and thus the underside layer can be kept at a distance from the substrate when the substrate laying units are in the laid state.

Further an embodiment relates to a method, wherein after laying at least some of the surface laying units are detached from at least some of the substrate laying units and the detached part of the surface laying units is replaced by other surface laying units.

Further an embodiment relates to a method, wherein the detachment can be carried out by a user manually, in particular without tools.

Further an embodiment relates to a use, wherein the wear layer with the connecting structure attached thereto is used as a single-use parquet, which is replaced when worn out by another wear layer with a connecting structure attached thereto without sanding.

Further an embodiment relates to a use, wherein a floor, a ceiling, a wall or a staircase is used as the substrate.

Further an embodiment relates to a use, wherein the surface laying unit is used for detachable attachment to the substrate in the terrace field.

Exemplary embodiments of the present invention are described in detail below with reference to the following figures.

Identical or similar components are provided with the same reference numbers in different figures.

According to exemplary embodiments of the invention, in particular a surface laying unit (removable top layer) is provided with a detachable connection to the substrate and a substrate laying unit (parquet element) is provided with a detachable connection to the top layer.

Although specific exemplary embodiments are described below with reference to floor coverings, these exemplary embodiments can also be applied to wall or ceiling coverings.

Figure 1:
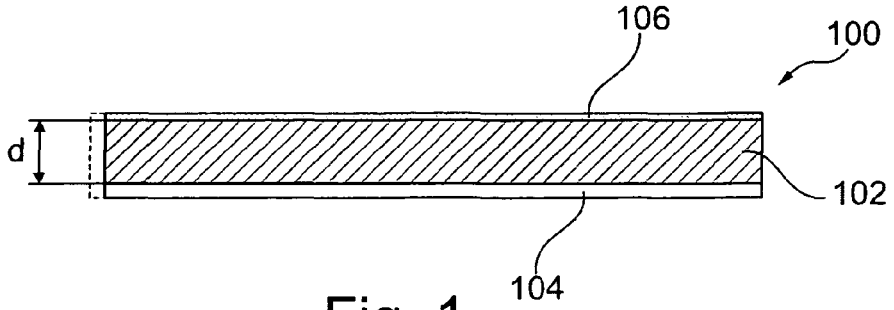
FIG. 1 shows a cross-sectional view of a surface laying unit according to an exemplary embodiment of the invention.

FIG. 1 shows a surface laying unit 100 for frictional or form-fitting laying together with other, similar surface laying units 100 on a substrate (not shown in FIG. 1). The board-like surface laying unit 100 formed according to the invention is shown in a cross-sectional view in FIG. 1. It can be seen there that each surface laying unit 100 comprises a wear layer 102 of single-piece wood, which has a thickness d of for example 2 mm. A protective varnish layer 106 is painted onto an upper side of the wear layer 102 to protect the wear layer 102 from mechanical and/or chemical influences of the environment. In other words, the protective varnish layer 106 is the layer on which a user treads when walking through a room in which the surface laying units 100 are laid as parquet.

On an underside of the wear layer 102 opposite the upper side with the protective varnish layer 106, a connecting layer 104 is adhesively bonded or attached in another manner, which is configured for connecting to the substrate. The connecting layer 104 can for example be a magnetic mat, a hook-and-loop fastening layer or the like, with which the surface laying unit 100 can be placed simply on a substrate (with a corresponding connecting layer for connecting to the connecting layer 104) to form the parquet. Time-consuming laying of the parquet is thereby unnecessary, since the surface laying unit 100 can not only be placed onto a substrate manually and thus without tools, but also be detached reversibly from the substrate by merely overcoming the hook-and-loop connection or magnetic connection by means of muscular force. According to the exemplary embodiment shown, the connecting layer 104 is attached over its full area to the entire underside of the wear layer 102. For example, a magnetic mat can be adhesively bonded as the connecting layer 104 to an underside of the wear layer 102.

As can be seen in FIG. 1, the structure of the surface laying unit 100 is conceivably simple, since it only comprises the wear layer 102, the protective coating 106 and the connecting layer 104, but does not comprise any further components and nevertheless can be placed directly onto a substrate to form the floor covering.

The wear layer 102 can for example be produced from solid or single-piece wood. It can have a thickness d such that it is suitable for one use cycle and should be replaced after this use. Alternatively, its thickness d can be such that it can be for example sanded once before it should be replaced after being worn down again. The thickness of the wear layer 102 can thus be much less than conventional two- or three-layered parquet.

In FIG. 1, it is indicated with dashed lines that a side face of the wear layer 102 can be provided at least partially (according to FIG. 1 only along half of the periphery) with the connecting structure 104, so that laterally adjacent surface laying units 100 are connected laterally to each other by means of the connecting structure 104 when in the laid state.

Figure 2:
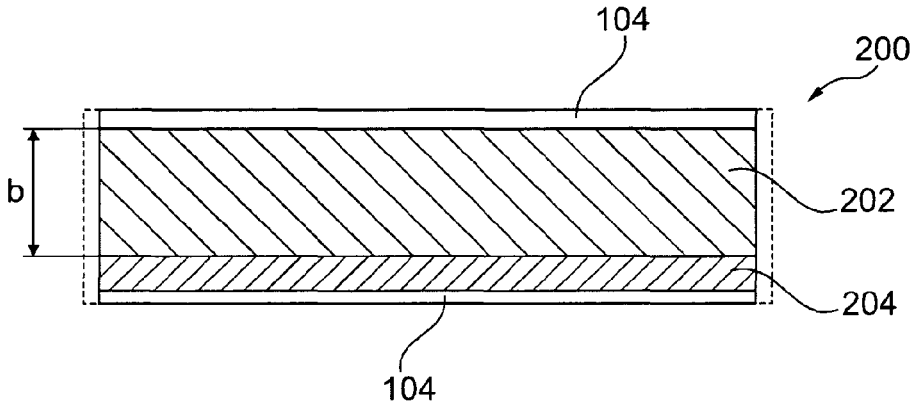
FIG. 2 shows a cross section of a substrate laying unit according to an exemplary embodiment of the invention.

FIG. 2 shows a substrate laying unit 200 according to an exemplary embodiment of the invention. This can be used for example together with the surface laying unit 100 shown in FIG. 1. The substrate laying unit 200 is configured for laying on a substrate (not shown in FIG. 2) with other substrate laying units 200 of the same type. This can in particular act as an underlay for the surface laying units 100 according to FIG. 1.

The substrate laying unit 200 comprises a stability layer 202 with a thickness b of for example 15 mm. The stability layer 202 can be produced from single-piece wood and is configured for stabilising a surface laying unit 100 to be attached above the stability layer 202.

On an upper side of the substrate laying unit 200, a connecting structure 104 is also adhesively bonded, which is fastened directly to the stability layer 202. The connecting layer 104 is configured for connecting to the connecting layer 104 of the surface laying unit 100 and is optional. In other words, the connecting layers 104 formed as magnetic mats are formed on the wear layer and on the stability layer 202 in such a manner that they attract each other.

The surface laying unit 100 therefore only needs to be placed onto the substrate laying unit 200 which is already laid on a substrate. FIG. 2 further shows that a further connecting layer 104 is attached to an underside of the substrate laying unit 200 opposite the upper side. This is likewise optional. The further connecting layer 104 is attached to an underside of a counteracting veneer layer 204, that is, a thin wood layer, which is adhesively bonded between the further connecting layer 104 and the stability layer 202. The counteracting veneer layer 204 acts to reduce walking noise when the parquet is laid and can reduce mechanical stresses which can be produced in the laid parquet. A connection of the underside of the substrate laying unit 200 to an on-site substrate can be further improved with the optional further connecting structure 104 on an underside of the counteracting veneer layer 204.

In FIG. 2, it is indicated with dashed lines that a side face of the stability layer 202 and/or of the counteracting veneer layer 204 can be provided at least partially (according to FIG. 2 along the entire periphery) with the connecting structure 104, so that laterally adjacent substrate laying units 200 are connected laterally to each other by means of the connecting structure 104 when in the laid state.

Figure 3:
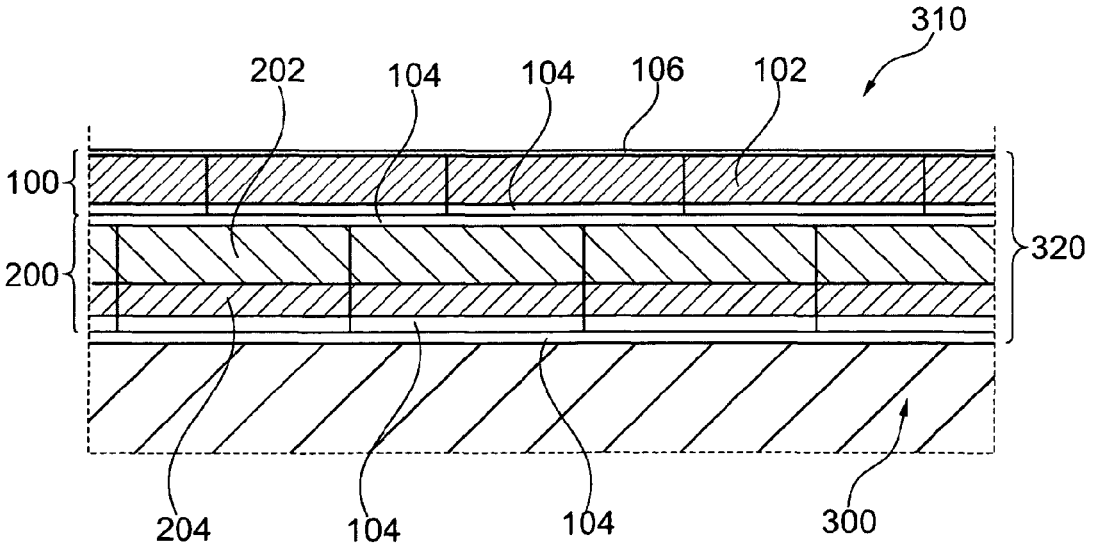
FIG. 3 shows parquet laid according to an exemplary embodiment of the invention, in which surface laying units according to FIG. 1 and substrate laying units according to FIG. 2 have been laid on a substrate.

FIG. 3 shows a parquet floor 310 according to an exemplary embodiment of the invention, which has been laid on a screed substrate 300.

An arrangement 320 is obtained by first laying a plurality of substrate laying units 200, as shown in FIG. 2, on the screed substrate 300. Beforehand, the screed substrate 300 can if necessary be provided with a connecting layer 104, for example a magnetic mat. This can be provided such that it is magnetically attractive to the connecting layer 104 formed as a magnetic mat on an underside of the substrate laying units 200. After the substrate laying units 200 have been laid on the screed concrete floor 300 equipped with the magnetic mat 104, individual surface laying units 100 can then be placed thereon. The connecting layers 104, 104 formed as magnetic mats on a boundary between the surface laying units 100 and substrate laying units 200 are also formed to attract each other. The arrangement 320 shown in FIG. 3 is obtained thereby.

Instead of the screed concrete floor 300, any other suitable substrate can also be used (e.g. tiles, parquet, screed, wood ceiling, asphalt etc.).

If for example a surface laying unit 100 is worn or damaged on the surface, it can simply be detached manually by overcoming the attractive magnetic force between the magnetic mats 104, 104 between a surface laying unit 100 and a substrate laying unit 200 brought correspondingly into contact. Another surface laying unit 100 can then be simply inserted. This is possible without tools, destruction or great effort, it being possible for the substrate laying units 200 which are present underneath and possibly still intact to remain laid in an unchanged manner. If a substrate laying unit 200 is damaged, the surface laying units 100 arranged above it can be temporarily removed, the damaged substrate laying unit 200 correspondingly likewise removed and replaced by another, defect-free substrate laying unit 200. The surface laying units 100 can then simply be put back, so even the replacement of individual substrate laying units 200 is possible with very little effort.

FIG. 3 shows in one dimension that the surface laying units 100 and the substrate laying units 200 have connecting edges to respectively adjacent surface laying units 100 and substrate laying units 200 respectively which are offset with respect to each other, which results in a configuration without butt joints which is therefore mechanically particularly stable.

Figure 4:
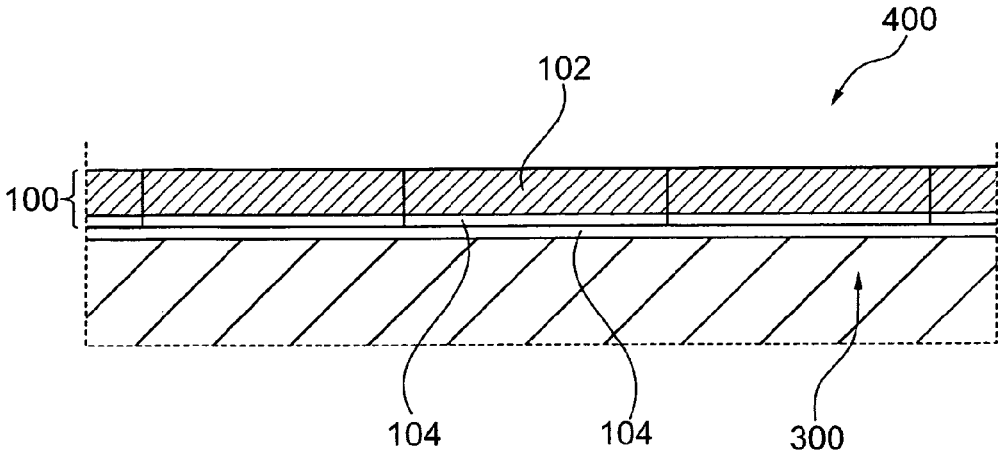
FIG. 4 shows another arrangement of laid parquet according to an exemplary embodiment of the invention, in which surface laying units according to an exemplary embodiment of the invention have been fastened to a substrate using two connecting layers.

FIG. 4 shows parquet 400 according to another exemplary embodiment of the invention, which is formed particularly simply.

According to one exemplary embodiment, individual surface laying units 100 are simply placed onto an on-site substrate 300 with a connecting mat 104 (for example magnetic mat) attached thereto. It is also possible to omit the connecting mat 104 on the upper side of the substrate 300, if for example the connecting layers 104 on the underside of the surface laying units 100 are formed from a multiple adhesive layer (for example double-sided adhesive tape) or as a non-slip mat or as an arrangement of suction cups, and therefore do not need a counterpiece.

Figure 5:
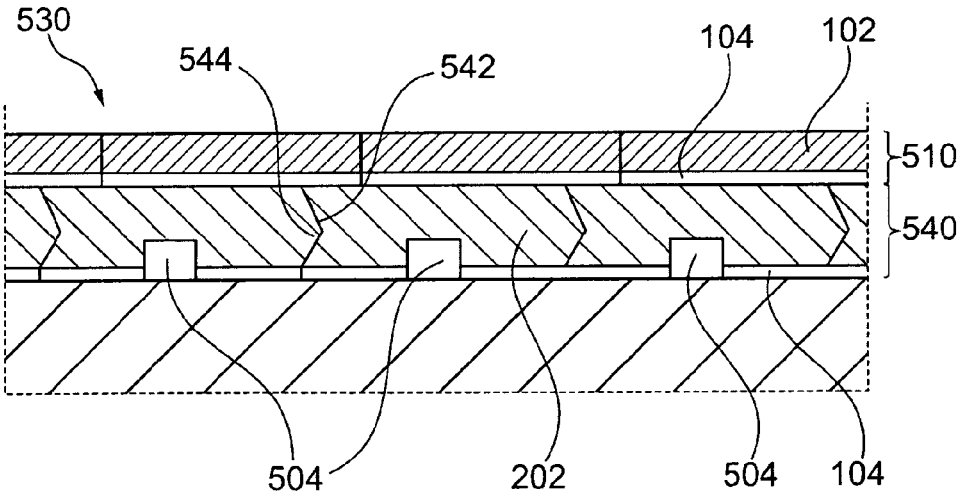
FIG. 5 shows another arrangement of surface laying units according to the invention and substrate laying units according to the invention, which have been laid on a substrate.

FIG. 5 shows parquet 530 according to another exemplary embodiment of the invention in the laid state. It is shown in FIG. 5 that the substrate laying unit 540 according to an exemplary embodiment of the invention, which is used there, comprises grooves 542 and corresponding tongues 5544 on side edges, so that adjacent substrate laying units 540 can simply be placed next to each other, forming a tongue and groove connection (other types of connections are likewise possible). It is also shown that cut-outs 504 in the form of air vents or cable channels can be provided on the underside and/or upper side of the substrate laying units 540, with which the functionality of the parquet 530 is further increased.

Figure 6:
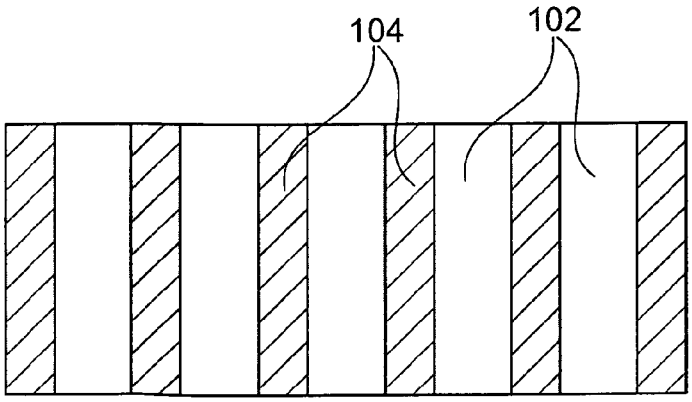
FIG. 6 shows a view from below of a surface laying unit according to an exemplary embodiment with separate connecting structures.

FIG. 6 shows a plan view of an underside of a surface laying unit according to an exemplary embodiment of the invention, in which individual connecting structures 104, for example individual magnetic mat strips, only cover part of the main face of the surface laying unit shown in FIG. 6. Costs for the magnetic mats can be saved thereby. Thermal coupling through the surface laying units can also be improved, which can be advantageous if under-floor heating is to be laid under the parquet.

Figure 7:
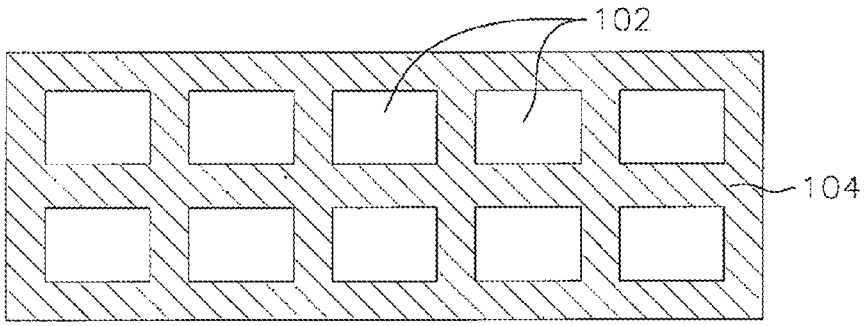
FIG. 7 shows a view from below of a surface laying unit according to an exemplary embodiment of the invention with a structured connecting layer.

FIG. 7 shows an underside of a surface laying unit according to yet another exemplary embodiment of the invention, in which an underside of a wear layer 102 is covered with a structured magnetic mat 104. This can likewise reduce costs and at the same time further improve the cohesion of the individual magnetic structures.

Measures according to FIG. 6 and FIG. 7 can also be used for substrate laying units according to the invention.

Figure 8:
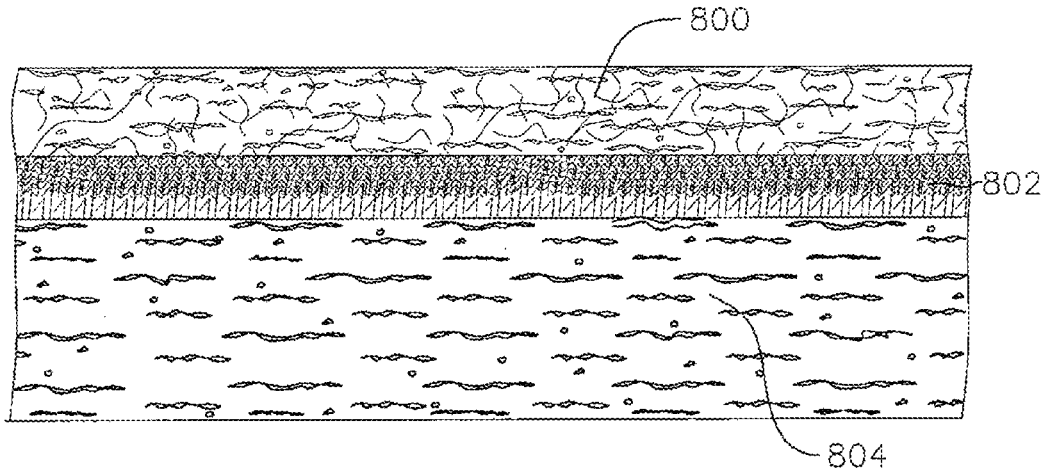
FIG. 8 to FIG. 10 show cross-sectional views of parquet modules according to exemplary embodiments of the invention.
Figure 9:
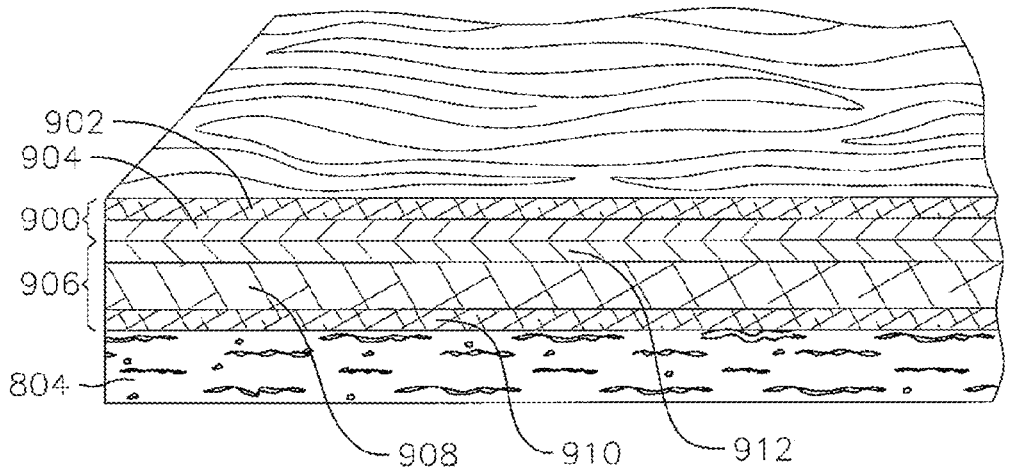
Figure 10:
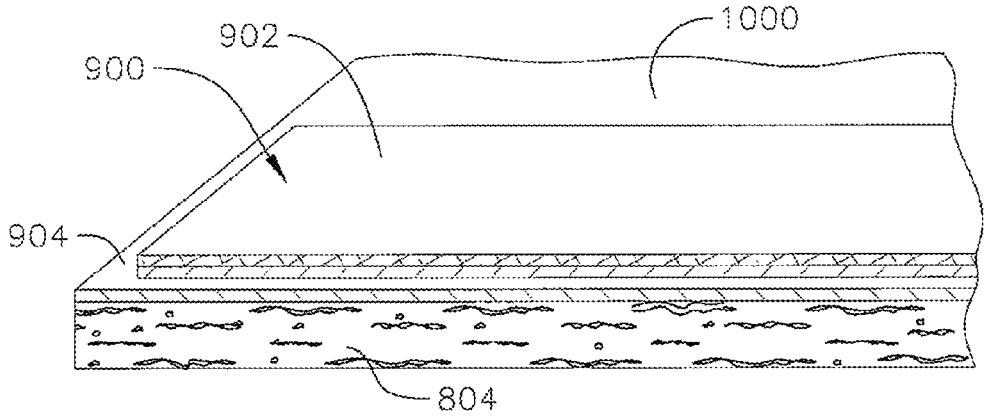

FIG. 8, FIG. 9 and FIG. 10 show different practical realisations of arrangements according to exemplary embodiments of the invention.

FIG. 8 shows that a multi-layered parquet 800 is connected to an on-site substrate 804 by means of hook-and-loop connecting layers 802.

FIG. 9 shows that a surface connecting element 900—consisting of a thin wear layer 902 and a magnetic mat connecting layer 904—is connected to an on-site substrate 804 with a substrate connecting element 906—consisting of a thick stability layer 908, a counteracting veneer layer 910 and a further magnetic mat connecting layer 912.

FIG. 10 shows that a surface connecting element 900—consisting of a thin wear layer 902 and a magnetic mat connecting layer 904—is connected directly to an on-site substrate 804, the substrate 804 comprising a further magnetic mat connecting layer 1000.

Figure 11:
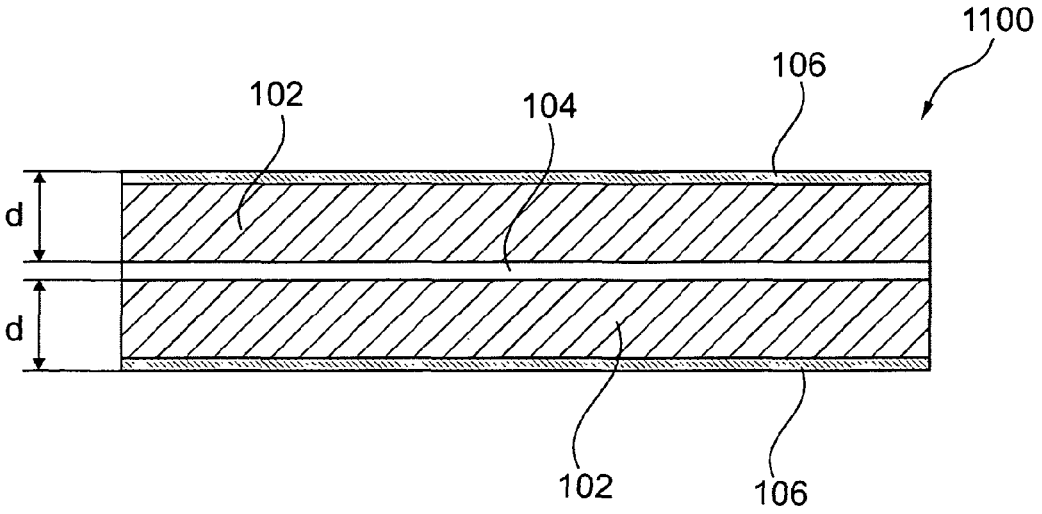
FIG. 11 shows a cross-sectional view of a surface laying unit according to an exemplary embodiment of the invention, which is configured as a reversible parquet.

FIG. 11 shows a cross-sectional view of a surface laying unit 1100 according to an exemplary embodiment of the invention, which is configured as a reversible parquet. According to this exemplary embodiment, the surface laying unit 1100 comprises a further wear layer 102, which is arranged opposite the wear layer 102, separated by the connecting structure 104, so that the surface laying unit 1100 is configured as a reversible covering.

The surface laying unit 1100 contains two top layers 102 comprising a magnetic mat 104 in the centre. The parquet can thus be laid on both sides. E.g. each side comprises a different surface, colour etc. In FIG. 11, the two wear layers 102, 102 are shown with the same thickness d. It is however also possible to provide the two layers 102, 102 with different thicknesses. The force of the magnetic mat 104 clearly acts through the two wood layers 102. For this reason, it can be advantageous to form the thickness d in a size between 1 mm and 5 mm, in particular in a size between 2 mm and 4 mm.

Figure 12:
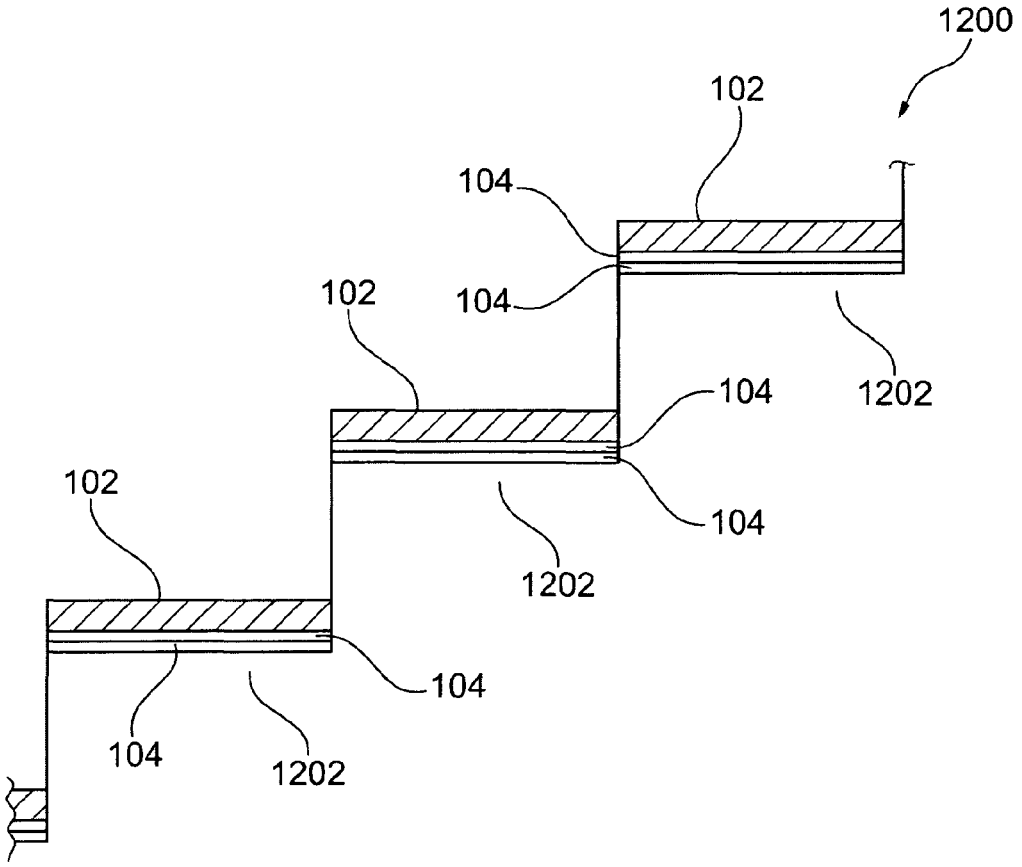
FIG. 12 shows a cross-sectional view of a surface laying unit according to an exemplary embodiment of the invention, which is on horizontal surfaces of a staircase.

FIG. 12 shows an arrangement 1200 according to an exemplary embodiment of the invention in a cross-sectional view, surface laying units consisting of the magnetic mat 104 and wear layer 102 being laid on horizontal surfaces of stair treads 1202 of a staircase, which are laid with magnetic mats 104 as the connecting layers.

Figure 13:
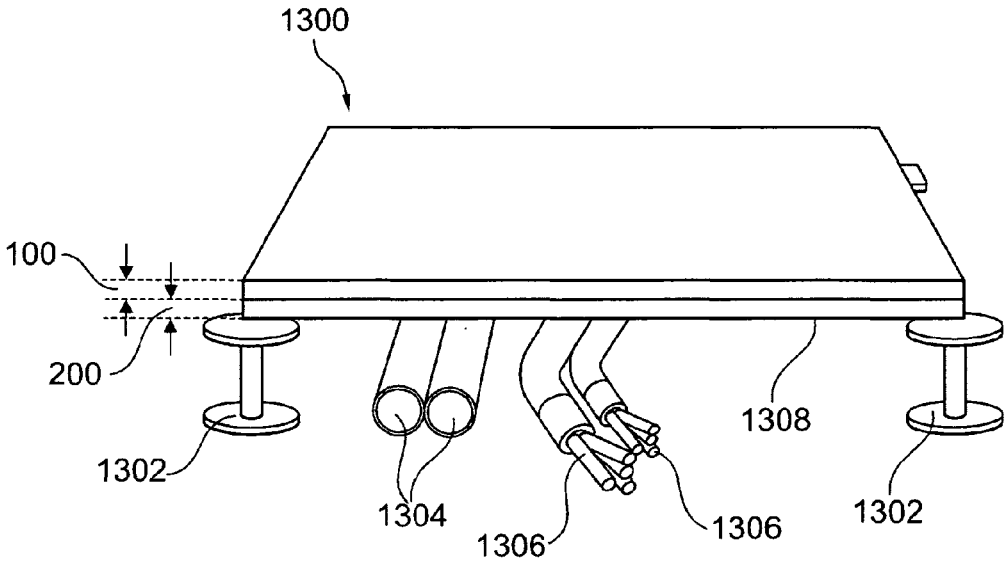
FIG. 13 shows another arrangement of a surface laying unit according to the invention and a substrate laying unit according to the invention, which are together formed as a double-floor laying unit.

FIG. 13 shows another arrangement of a surface laying unit 100 according to the invention (comprising the above-described features, see for example FIG. 3) and a substrate laying unit 200 according to the invention (comprising the above-described features, see for example FIG. 3), which are together formed as a double floor laying unit 1300. In this case supports 1302 are inserted as spacers between the substrate and the substrate laying unit 200. The surface laying unit 100 is placed detachably and replaceably on the substrate laying unit 200. Any desired functional elements, such as empty conduits 1304, electrical cables 1306 etc., can be accommodated in the empty space between the substrate and the substrate laying unit 200 maintained by means of the supports 1302.

By means of the supports 1302 as the spacer structure, an empty space can be formed between an underside layer 1308 of the substrate laying unit 200 and the substrate and thus the underside layer 1308 can be kept at a distance from the substrate when the substrate laying unit 200 is in the laid state.

In this connection, a double floor means a second floor over, i.e. at a distance from, the actual substrate of the room. Any point of the room underneath the double floor thereby remains accessible at any time. A double floor is thereby particularly suitable for rooms with frequent changes to the installations and if the installations should be quickly accessible at any time.

Figure 14:
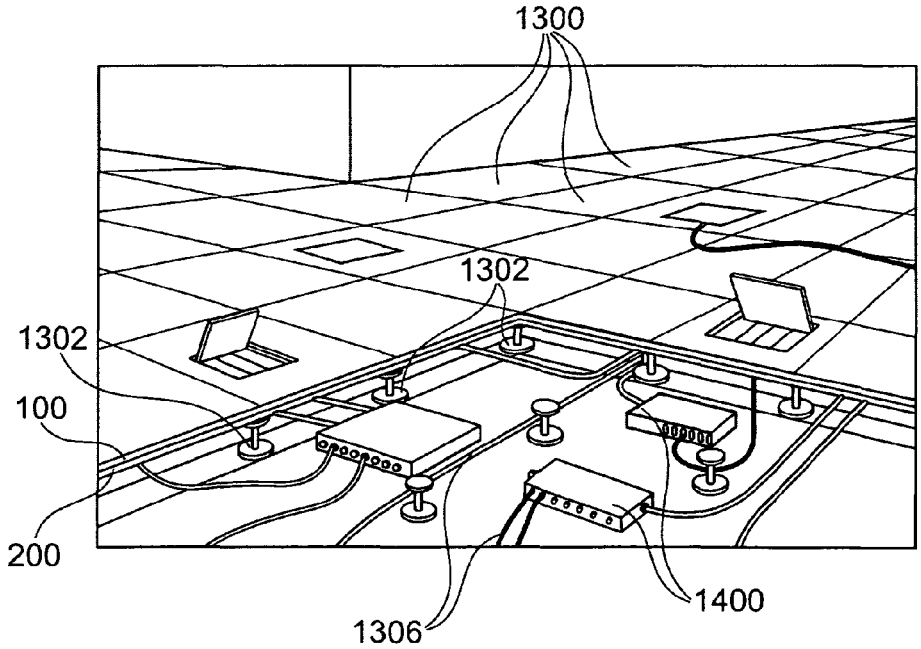
FIG. 14 shows another arrangement of double floor laying units according to the invention, according to FIG. 13.

FIG. 14 shows another arrangement 14 of double floor laying units 1300 according to the invention, according to FIG. 13. FIG. 14 shows further functional elements in the form of electrical devices 1400, which can be electrically supplied and/or connected to each other by means of the electrical cables 1306.

Figure 15:
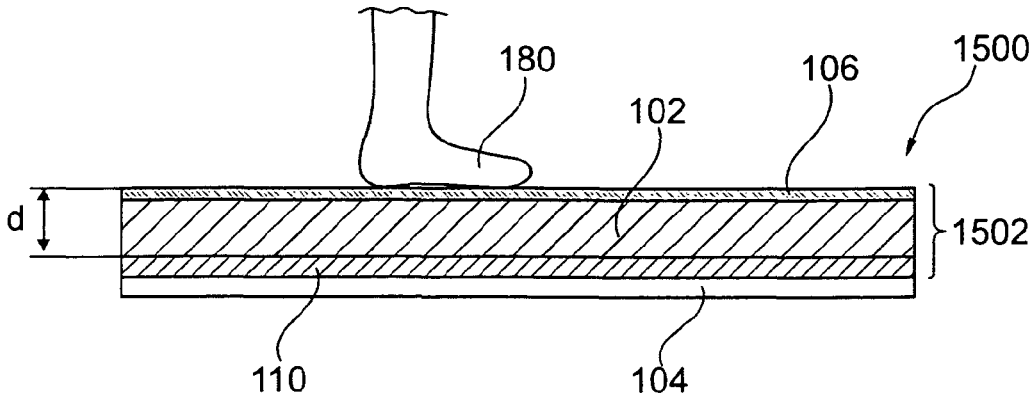
FIG. 15 shows a cross-sectional view of a surface laying unit according to an exemplary embodiment of the invention with a sound-absorbing layer close to the surface.

FIG. 15 shows a cross-sectional view of a surface laying unit 1500 according to an exemplary embodiment of the invention with a sound-absorbing layer 110 close to the surface.

A wear layer 1502 is again provided in the surface laying unit 1500. This wear layer 1502 comprises a hard covering layer 102, 106 of thickness d (see FIG. 1) and a sound-absorbing layer 110, which is attached directly to an underside of the hard covering layer 102, 106 and is configured to damp sound when the hard covering layer 102, 106 is loaded with a sound-generating load. FIG. 15 shows that the hard covering layer 102 is formed as surface layer.

The hard covering layer 102, 106 is a surface layer consisting of superficially varnished (coated) solid wood. That means that the hard covering layer 102, 106 forms the surface of the substrate covering when the surface laying unit 1500 is laid. In other words, a user places his foot 180 directly on the hard covering layer 102, 106 when he walks on the parquet when it is laid. The hard covering layer 102, 106 has the thickness d of 3 mm in this exemplary embodiment. Furthermore, a continuous foam layer is attached to the underside of the hard covering layer 102, 106 as the sound-absorbing layer 110. This is configured to damp acoustic waves or sound generated when a walking load is exerted on the hard covering layer 102, 106 or to suppress further production of sound. Therefore, if a user walks on the surface laying unit 1500 laid on a substrate (not shown in FIG. 15), the production of sound waves can occur. Owing to the provision of the hard covering layer 102, 106 with the said low thickness, a movement of a user on the surface laying unit 1500 results in the hard covering layer 102, 106 being noticeably bent and thus avoiding a corresponding load. This effect is combined with a corresponding compression, generating a restoring force, of the sound-absorbing layer 110. The combination of these two effects results in a significant suppression of the sound produced and thus in a parquet laying unit 1500 with low walking noise, as measurements of the applicant have shown.

The hard covering layer 102, 106 consists in this exemplary embodiment of one single-material wood layer 102, which is covered on the surface side with a layer of protective varnish (or oil) 106. The protective varnish (or oil) 106 is a highly elastic varnish on the surface of the surface laying unit 1500, which is exposed to the direct effect of mechanical and chemical influences. This varnish is configured to follow the compensating movement of the thin wood layer 102 elastically (that is, without breaking or plastic deformation) and to block mechanical effects on the surface of the hard covering layer 102, 106 from the wood layer 102.

Figure 16:
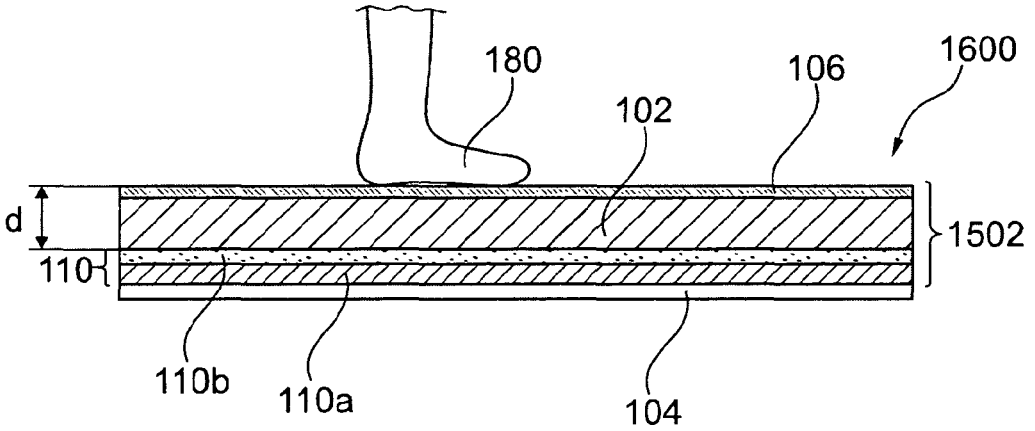
FIG. 16 shows another surface laying unit according to the invention, in which a sound-absorbing layer is formed from a stabilisation part layer and a damping part layer.

FIG. 16 shows another surface laying unit 1600 according to the invention, in which a sound-absorbing layer 110 is formed from a glass fibre mat 110*b* as the stabilisation part layer and a foam layer 110*a* as the damping part layer. The foam layer 110*a* can be adhesively bonded, in particular glued, to the glass fibre mat 110*b*. Alternatively to FIG. 16, the foam layer 110*a* can be arranged on the upper side and the glass fibre mat 110*b* can be arranged on the underside.

The glass fibre mat 110*b* has the function of stabilising the wood layer 102 in the event of continued working (i.e. continued slight movement) of the wood layer 102 following production or laying of the surface laying unit 1600. The glass fibre mat 110*b* clearly blocks off the wood layer 102, i.e damps or suppresses this work.

To produce the composite of the glass fibre mat 110*b* and the foam layer 110*a*, liquid adhesive can be applied to the underside of the wood layer 102. After the glass fibre mat 110*b* and then the foam layer 110*a* have been applied to the underside of the wood layer 102, the liquid adhesive penetrates first the glass fibre mat 110*b* and then the foam layer 110*a* and thus ensures a close connection of these components.

Figure 17:
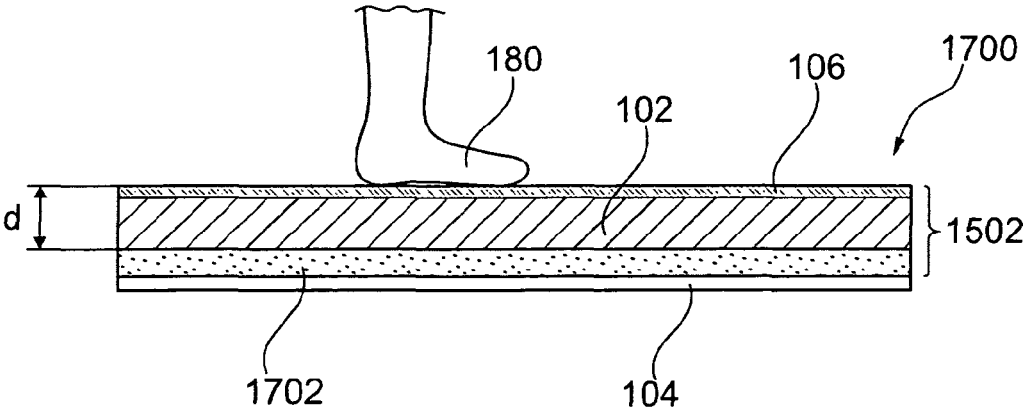
FIG. 17 shows a further surface laying unit according to the invention, in which a glass fibre mat is arranged as the stabilisation layer between a hard covering layer and a connecting layer.

FIG. 17 shows a further surface laying unit 1700 according to the invention, in which a glass fibre mat 1702 is arranged as the stabilisation layer between a hard covering layer 102, 106 and a magnetic mat 104 as the connecting layer. The said stabilisation layer can absorb or suppress forces of the wood of the wood layer 102 when the wood is worked.

It should also be pointed out that "comprising" does not exclude any other elements or steps and "a" or "one" does not exclude a plurality. It should also be pointed out that features or steps which have been described with reference to one of the above exemplary embodiments can also be used in combination with other features or steps of other above-described exemplary embodiments. Reference symbols in the claims should not be considered a limitation.

The invention claimed is:

1. An arrangement for forming a covering on a substrate, wherein the arrangement comprises:

a plurality of substrate laying units, which can be laid together on the substrate to cover the substrate and can be connected to the substrate, wherein one substrate laying unit comprises:

a stability layer, which is rigid in a board-like manner, for stabilizing a surface laying unit, which can be attached above the stability layer; and a connecting structure, which is attached directly to an upper side of the substrate laying unit and is configured for connecting to the surface laying unit, wherein the connecting structure does not comprise a portion of a hook-and-loop fastener;

wherein an underside of the substrate laying unit opposite the upper side is configured for connecting to the substrate;

wherein a first side face of the stability layer comprises a first engagement element, and a second side face of the stability layer comprises a second engagement element, complementary to the first engagement element, wherein the first engagement element can be connected to a corresponding second engagement element and the second engagement element can be connected to a corresponding first engagement element of corresponding substrate laying units;

a plurality of surface laying units which are provided separately from the substrate laying units and are configured to cover the laid substrate laying units, wherein one surface laying unit comprises:

a wear layer, wherein the wear layer is produced from solid wood, has a thickness in a range between 0.5 mm and 4 mm, and is formed as a board;

a further connecting structure, which is attached directly to the underside of the wear layer and is configured for detachably connecting the surface laying units to the substrate laying units, wherein the further connecting structure does not comprise a portion of a hook-and-loop fastener.

2. The arrangement according to claim 1, wherein a side face of the wear layer is provided at least partially with the connecting structure, so that laterally adjacent surface laying units are connected to each other via the connecting structure when in the laid state.

3. The arrangement according to claim 1, wherein a main surface of the surface laying unit has an area in a range between 0.001 $m^2$ and 0.5 $m^2$.

4. The arrangement according to claim 1, consisting exclusively of the wear layer and the connecting structure, or consisting exclusively of the wear layer, the connecting structure and a protective coating.

5. The arrangement according to claim 1, comprising a further wear layer, which is arranged opposite the wear layer, separated by the connecting structure, so that the surface laying unit is configured as a reversible covering.

6. The arrangement according to claim 1, wherein the wear layer comprises a hard covering layer and a sound-absorbing structure, which is attached directly to a main surface of the hard covering layer and is configured for damping sound when the hard covering layer is loaded with a sound-generating load; wherein the hard covering layer is formed as a surface layer.

7. The arrangement according to claim 1, wherein the stability layer directly borders the wear layer.

8. The arrangement according to claim 1, wherein the stability layer is formed as a fibre layer or as a fibre mat and is selected from a group which consists of a glass fibre mat and a carbon fibre mat.

* * * * *